United States Patent [19]

Monti

[11] Patent Number: 4,919,288

[45] Date of Patent: Apr. 24, 1990

[54] HERMETIC SEAL DEVICE FOR GLASS JARS

[75] Inventor: Roberto L. Monti, Roma, Italy

[73] Assignee: Vetreria Parmense Bormioli Rocco S.p.A., Parma, Italy

[21] Appl. No.: 339,780

[22] Filed: Apr. 18, 1989

[30] Foreign Application Priority Data

Jun. 8, 1988 [IT] Italy ..... 40091 A/88

[51] Int. Cl.[5] ..... B65D 45/02

[52] U.S. Cl. ..... 215/284

[58] Field of Search ..... 215/274, 275, 284; 220/219, 220, 221

[56] References Cited

U.S. PATENT DOCUMENTS

| | | | |
|---|---|---|---|
| 559,269 | 2/1898 | Stadel | 215/284 |
| 1,025,942 | 5/1912 | Bellamy | 215/274 |
| 1,935,470 | 11/1933 | Johnson | 215/284 |
| 3,185,332 | 5/1965 | Greenstein | 215/284 X |

FOREIGN PATENT DOCUMENTS

| | | | |
|---|---|---|---|
| 2452766 | 5/1976 | Fed. Rep. of Germany | 215/284 |

*Primary Examiner*—Donald F. Norton

*Attorney, Agent, or Firm*—Browdy and Neimark

[57] ABSTRACT

The device permits of compressing a rubber ring (4) between the mouth of a glass jar (1) and its glass lid (2), and comprises a collar (5) that is secured initially to the lid, whereupon the lid and collar are offered to the jar; a lip (6), integral with the collar, hooks under a rim (7) afforded by the neck of the jar, and the lid is then tightened by pulling down on a lever (9) hinged to a pair of lugs (8), likewise integral with the collar. The collar also incorporates a skirt (18) that conceals the area of contact between the lid, the rubber ring and the mouth of the jar.

6 Claims, 2 Drawing Sheets

Fig. 3
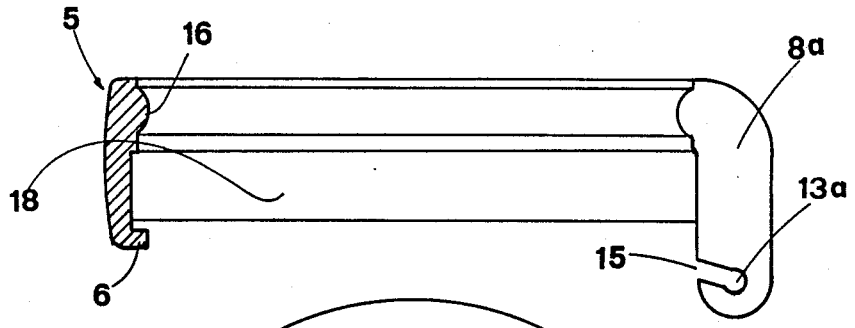
Fig 4
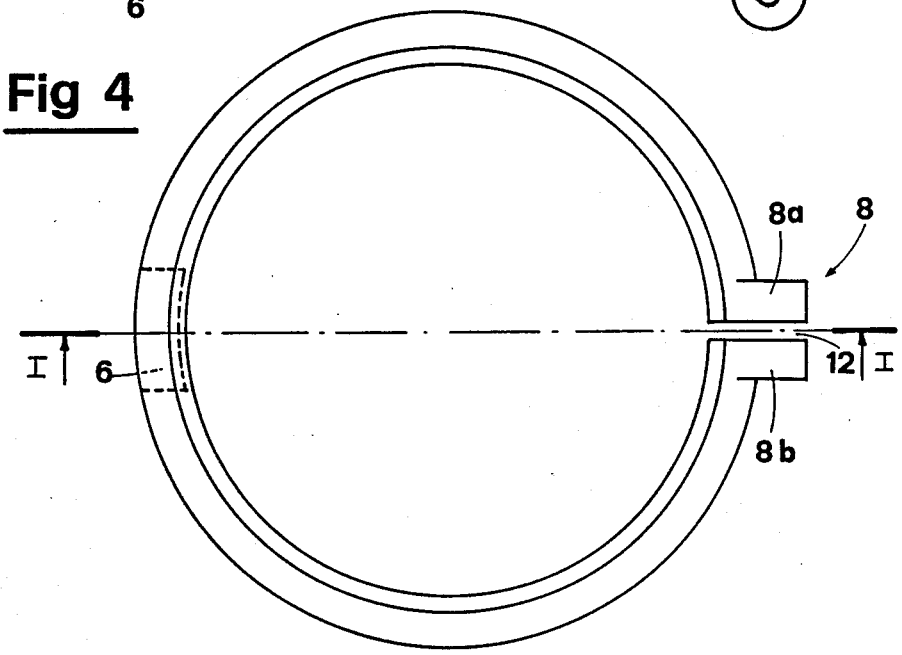
Fig. 5
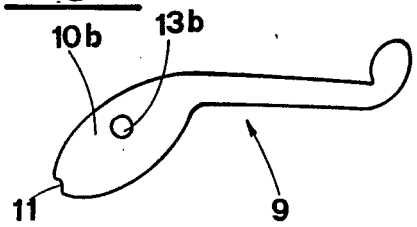
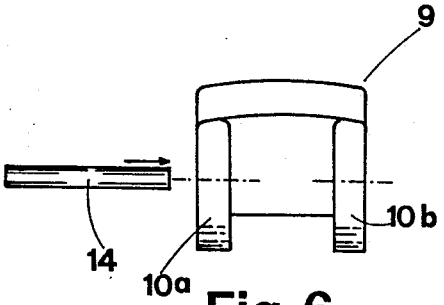
Fig. 6

HERMETIC SEAL DEVICE FOR GLASS JARS

BACKGROUND OF THE INVENTION

The invention relates to a hermetic seal device for glass preserving jars.

Widespread use has been made for a considerable time, particularly in the household, of containers consisting in a glass jar and a lid, likewise glass, which are fitted together hermetically by locating an annular seal, generally a rubber ring, between jar and lid, then applying pressure and retaining the ring in position with clamping means of varying design.

The fact that both jar and lid continue to be made from glass, the material still most widely preferred from the standpoints of health and hygiene, necessarily dictates that the clamping means be separately and independently embodied (in a material other than glass needless to say) and their assembly with the container effected at a later stage.

One of the most commonplace devices currently in use consists in a wire hoop comprising two parts, one of which fixed to the lid, the other to the neck of the jar, which are drawn together and held by a clasp; the device thus exerts sufficient pressure to keep the lid and jar held firmly together.

The main disadvantage of this type of device is, that once the two parts are fitted respectively to the jar and the lid, they cannot easily be removed; as a result, the user experiences difficulty in cleaning the container, and should either the lid or the jar break accidentally, the remaining component of the container is rendered practically useless.

Another known device consists in a suitably profiled spring clip which, with the lid in position on the jar, is forced down onto the lid and its ends located under an annular rim offered by the neck of the jar. Such a device is free of the disadvantages mentioned above, but betrays the drawback that the spring can easily deform, especially when opening the jar, to the degree that the requisite pressure may no longer be guaranteed when replacing the lid. A further drawback, of no small importance when one considers the household use to which containers of this type are put, is that the spring clip cannot be permanently fastened to either one of the components of the container when the lid is removed, and often becomes mislaid as a result.

The object of the invention is to overcome the drawbacks described above, by providing a hermetic seal device that affords several advantages at one and the same time, namely, of being easily joined to and separated from one component of the container, of rendering the components of the container easy to clean, of ensuring a correct clamping pressure between lid and jar even after repeated refitting and removal, and of enabling complete separation of lid and jar whenever the container is opened.

Further advantages of the device disclosed are that it is pleasing in appearance, and that it conceals the entire area of contact between lid, jar and ring when the container is sealed, affording good protection from dust, in particular.

SUMMARY OF THE INVENTION

The stated object and advantages and others besides are realized with a hermetic seal device as disclosed herein; such a device comprises a collar, fastened stably to the lid of the jar but easily detachable therefrom if need be, and provided with a catch and a lever which, when sealing the container, engages with an annular rim afforded by the neck of the jar in such a way as to ensure the requisite clamping force between jar and lid.

BRIEF DESCRIPTION OF THE DRAWINGS

The invention will now be described in detail, by way of example, with the aid of the accompanying drawings, in which:

FIG. 3 is a vertical and diametral section through the collar of the device disclosed;

FIG. 4 is the plan of FIG. 3, viewed from above;

FIG. 5 shows a side elevation of the lever of the device disclosed;

FIG. 6 is a side elevation of the lever of FIG. 5, viewed from the left.

DESCRIPTION OF THE PREFERRED EMBODIMENTS

Figure 1:
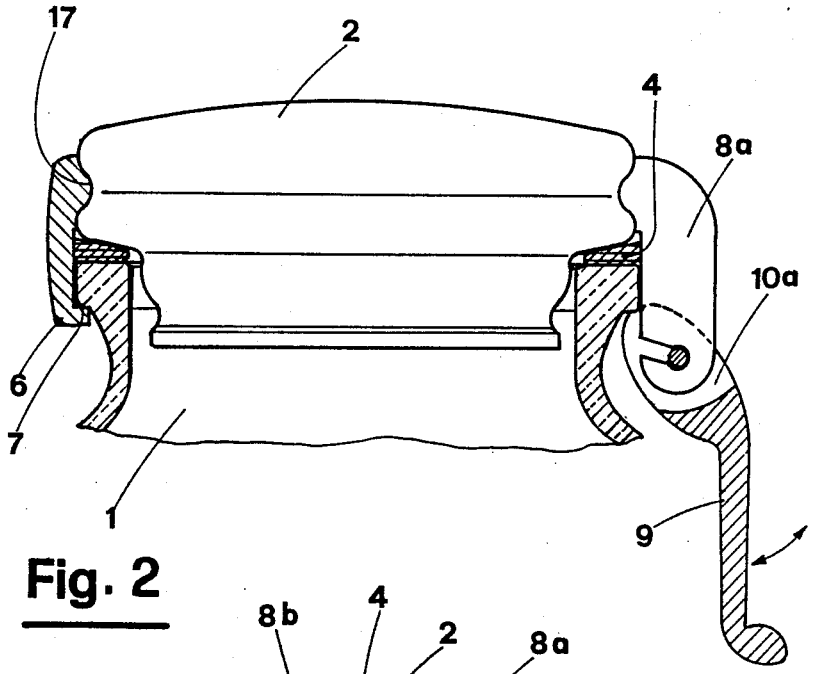
FIG. 1 is the vertical and diametral section through a container sealed with the device according to the invention, in which the lid of the container is seen in full elevation.
Figure 2:
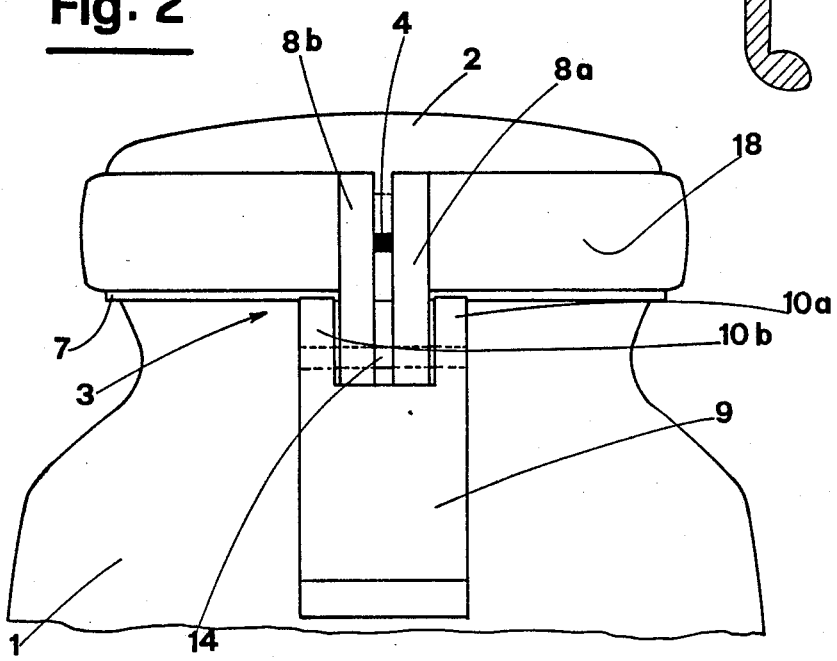
FIG. 2 is a side elevation of the container sealed with the device as in FIG. 1, viewed from the right.

The device disclosed is of the type for fitment to containers consisting in a glass jar 1 (only the top part comprising the neck and mouth is shown in the drawings) and a lid 2, also in glass, between which an annular element 4 is located in such a way as to render the container fluid-tight; the annular element 4 will generally be a rubber ring which, compressed between the lid and the mouth of the jar, ensures a hermetic seal.

The device comprises a collar 5, preferably in plastic material, which is of annular shape and exhibits a gap 12 that occupies a vertical radial plane and serves to break the annular continuity. 16 denotes an inwardly-directed annular projection issuing from the collar 5, which ensures a stable connection between collar and lid by registering in a corresponding annular recess 17 afforded by the lid 2 itself. The gap 12 combines with the natural flexibility of the material from which the collar 5 is fashioned, to afford a degree of deformability that greatly facilitates insertion and removal of the annular projection 16 into and from the annular recess 17, and accordingly, greatly facilitates the operations of fastening and separating the collar 5 to and from the lid 2.

18 denotes an annular skirt, extending down below the projection 16, the purpose of which will become clear in due course.

The collar 5 is provided with a lip 6 occupying a short circular sector of its annular profile, which extends downward in such a way as to locate against the underside of an annular rim 7, afforded by the neck of the jar, when the assembled lid and collar are offered to the mouth of the jar.

The collar 5 further comprises a protruberance 8 the bottom end of which extends below the annular rim 7 of the neck of the jar when the lid and collar are offered to the mouth. This same protruberance 8 comprises two lugs **8*a* and 8*b* positioned on either side of and extending parallel with the gap 12. 13*a* denotes a pair of holes, one passing through the bottom of each lug 8*a* and 8*b* of the protruberance 8, which are coaxially disposed and will be described more fully in due course. Similarly, 15 denotes one of two open-ended parallel slots that extend toward and merge respectively with the two holes 13*a*** in such a way as to create a pair of radial passages, likewise to be described more fully in due course.

The lip 6 and the protruberance 8 are located at diametrically opposed positions on the collar 5.

Finally, the device comprises a lever 9, the arm of which incorporates a cam profile; more exactly, the arm is embodied as a clevis with two parallel members 10*a* and 10*b*, each one of which carries the profile. The distance separating the two members 10*a* and 10*b* of the clevis is equal to the overall width of the protruberance 8.

The cam profile, or rather, each of the two cam-profiles exhibited by the two members 10*a* and 10*b*, includes a notch 11 the purpose of which is to limit further rotation of the lever 9 on arrival at a stable position.

13*b* denotes a hole passing through each of the two clevis members 10*a* and 10*b*. The two holes are coaxial, and their diameter substantially identical to that of the holes 13*a* passing through the two lugs 8*a* and 8*b* of the protruberance 8. The lever 9 is pivotably mounted to the protruberance 8 by means of a pin 14 inserted through the two pairs of holes 13*a* and 13*b*. Notwithstanding the holes 13*a* and 13*b* are of the same nominal diameter, in a preferred embodiment of the lever, the holes 13*b* of the clevis will be proportioned in such a way as to achieve an interference fit with the pin 14, whereas the holes 13*a* in the lugs 8*a* and 8*b* will accommodate the pin freely.

According to the invention, the plastic material in which the device is embodied will not be deformed even at temperatures in excess of 100° C. Thus, the sealed container and its contents can be sterilized by the procedure commonly adopted in the household, namely, that of immersion in boiling water for a given length of time.

Assembly, separation and use of the device thus illustrated are simple in the extreme, and will now be described.

Whilst the container will preferably be marketed already sealed, with the device fitted to the lid, the description departs from a situation in which the various components of the device, the lid, and the jar, are all separate, so as to underline the abundant simplicity of the single steps involved in assembly and removal.

The various components of the device are connected to the lid of the container, but remain completely separated from the jar until the actual moment in which the hermetic seal is effected.

The collar 5 is fitted onto the lid 2 in such a way that the annular projection 16 registers in the annular recess 17; to render the operation easy, it suffices simply to spread the two lugs 8*a* and 8*b* of the protruberance 8, and slip the collar over the lid either from the top or from beneath. Once the projection 16 has slipped into the recess 17, the two lugs 8*a* and 8*b* will draw together by virtue of the flexible characteristics of the material in which the collar is embodied.

Next, the pin 14 is inserted into the holes 13*b* of the lever 9 (it will be remembered that this is an interference fit, to ensure that the pin 14 does not work free from the holes accidentally) whereupon the ends of the pin 14 are edged along the slots 15 and seated in the holes 13*a* of the protruberance 8.

At this stage the lever 9 is pivotably suspended from the protruberance 8, and the two members 10*a* and 10*b* of the clevis (which, it will be remembered, are spaced apart by a distance equal to the overall width of the protruberance) breasted with the sides of the two lugs 8*a* and 8*b* and preventing them from spreading: accordingly, any accidental separation of collar and lid 2 is rendered impossible.

With the device fitted to the lid 2, the rubber ring 4 is easily located by insertion from beneath, as the bottom of the lid and collar assembly remains completely open.

To effect the hermetic seal it suffices to offer the assembled lid and collar to the mouth of the jar at a slight angle, in such a way that the lip 6 can locate beneath the annular rim 7, and with the lever angled upwards. Applying downward pressure on the lid 2 at this point to bring it horizontal, and rotating the lever 9 clockwise (as viewed in FIG. 1), the cam profile will engage the rim 7 of the jar; applying further pressure now through the lever, hence through the pin 14 and the protruberance 8, the collar 5 will continue to be invested with a downwardly directed force, and compress the rubber ring between the lid and the jar. The lever 9 is pushed down to the point where the annular rim 7 engages in the notch 11 of the cam profile, and it is in this position, with the ring 4 compressed fully between lid and jar, that a hermetic seal is assured. This position of the lever 9, moreover, is one of complete stability, since marginal rotation of the lever in either direction (see FIG. 1) has the effect of increasing the clamping force applied to the protruberance 8.

It will be observed that by including the skirt 18, the area at which the lid, the rubber ring and the mouth of the jar are brought together remains totally concealed when the container is sealed; thus, one succeeds not only in gaining a pleasing appearance, but also, in protecting the area of the seal from dust and foreign matter in general.

All that is required to open the container is to rotate the lever 9 counterclockwise (as viewed in FIG. 1) through an angle sufficient for the step of the notch 11 to clear the annular rim 7; this done, the cam profile will gradually separate from the rim, and in so doing, release the protruberance 8 from the clamping force exerted hitherto.

With the lid released, the jar 1 remains quite free of any extraneous parts, as all the components making up the device are associated with the lid 2; accordingly, the jar is extremely easy to clean.

To clean the lid and the device, the user simply slides the pin 14 away from the holes 13*a* and out along the slots 15 so as to isolate the lever 9 altogether. This accomplished, the two lugs 8*a* and 8*b* of the protruberance are easily spread, and the lid 2 removed from the collar 5; thus, one achieves a total separation of the parts of the device for cleaning purposes.

What is claimed:

1. A hermetic seal device for glass jars, of the type designed to compress an annular sealing element (4) permanently between the glass lid (2) and the neck of the jar (1), comprising:

a collar (5), fastened stably to the periphery of the lid (2), incorporating a lip (6) shaped and positioned in such a way as to locate beneath an annular rim (7), afforded by the neck of the jar, when the assembled lid and collar are applied to the neck of the jar, and a protruberance (8) the bottom end of which extends below the level of the annular rim (7) when the assembled lid and collar are applied to the neck of the jar;

a lever (9), pivotably suspended from the bottom end of the protruberance and comprising an arm (10*a*, 10*b*) with a cam profile having a notch (11) that permits of halting the rotation of the lever on arrival at a given stable position, which, when the assembled lid and collar are applied to the neck of the jar and the lever rotated, engages with the annular rim afforded by the neck of the jar and to the protruberance a force that draws the collar and lid toward the jar.

2. A device as in claim 1, comprising:

a collar (5) that exhibits a gap (12), occupying a vertical radial plane and serving to break the annular continuity of the collar;

a protruberance (8) that consists in two lugs (8*a*, 8*b*) located either side of and extending parallel with the gap;

a lever (9) in which the cam profile of the arm is embodied as a clevis with two members (10*a*, 10*b*) separated by a distance equal to the overall width of the protruberance;

coaxial holes (13*a*, 13*b*) passing through the two lugs and the two members of the clevis and serving to accommodate a pin (14) that functions as a pivot for the lever.

3. A device as in claim 2, comprising two open-ended parallel slots (15), each extending toward and merging with a respective hole (13*a*) in said lugs (8*a*, 8*b*) of the protruberance, which afford access to the holes through a radial direction.

4. A device as in claim 1, wherein the collar is provided internally with an annular projection (16) that registers to an exact fit in a corresponding annular recess (17) afforded by the lid (2), and at bottom, with an annular skirt (18) that serves to conceal the outermost part of a rubber ring (4) and at least a given stretch of the area of the neck of the jar lying above the annular rim (7), when the assembled lid and collar are offered to the neck of the jar.

5. A device as in claim 2, wherein the collar is provided internally with an annular projection (16) that registers to an exact fit in a corresponding annular recess (17) afforded by the lid (2), and at bottom, with an annular skirt (18) that serves to conceal the outermost part of a rubber ring (4) and at least a given stretch of the area of the neck of the jar lying above the annular rim (7), when the assembled lid and collar are offered to the neck of the jar.

6. A device as in claim 1, wherein the lip (6) and the protruberance (8) occupy positions on the collar that are diametrically opposed.

* * * * *